US007817126B2

(12) United States Patent
Ha et al.

(10) Patent No.: US 7,817,126 B2
(45) Date of Patent: Oct. 19, 2010

(54) LIQUID CRYSTAL DISPLAY DEVICE AND METHOD OF DRIVING THE SAME

(75) Inventors: Sung Chul Ha, Yoesu-si (KR); Man Gyu Park, Iksan-si (KR)

(73) Assignee: LG. Display Co., Ltd., Seoul (KR)

( * ) Notice: Subject to any disclaimer, the term of this patent is extended or adjusted under 35 U.S.C. 154(b) by 1149 days.

(21) Appl. No.: 11/476,368

(22) Filed: Jun. 27, 2006

(65) Prior Publication Data

US 2007/0046613 A1 Mar. 1, 2007

(30) Foreign Application Priority Data

Aug. 23, 2005 (KR) ..... 10-2005-0077302

(51) Int. Cl.
*G09G 3/36* (2006.01)

(52) U.S. Cl. ..... 345/95; 345/99

(58) Field of Classification Search ..... 345/87, 345/90, 94, 95, 98–100, 103
See application file for complete search history.

(56) References Cited

U.S. PATENT DOCUMENTS

| | | | | |
|---|---|---|---|---|
| 5,555,001 | A * | 9/1996 | Lee et al. | 345/93 |
| 5,852,426 | A | 12/1998 | Erhart et al. | |
| 7,199,662 | B2 * | 4/2007 | Seko | 330/261 |
| 7,330,182 | B2 * | 2/2008 | Lee et al. | 345/421 |
| 7,649,787 | B2 * | 1/2010 | Kozuma et al. | 365/189.05 |
| 2002/0118154 | A1 * | 8/2002 | Kim | 345/87 |
| 2002/0167338 | A1 * | 11/2002 | Ito | 326/112 |
| 2003/0112386 | A1 * | 6/2003 | Bu | 349/96 |
| 2004/0233148 | A1 * | 11/2004 | Tanghe et al. | 345/83 |

FOREIGN PATENT DOCUMENTS

| | | |
|---|---|---|
| EP | 1 164 567 A2 | 12/2001 |
| JP | 10-115839 | 5/1998 |
| JP | 10-326090 | 12/1998 |
| JP | 2001-235723 | 8/2001 |
| JP | 2002-268613 | 9/2002 |
| JP | 2005-025179 | 1/2005 |
| JP | 2005-091505 | 4/2005 |
| JP | 2005-201974 | 7/2005 |
| WO | 03/065340 A1 | 8/2003 |

OTHER PUBLICATIONS

First Office Action for corresponding Chinese Patent Application Serial No. 200610087179.4, dated Oct. 26, 2007.
Search Report issued in corresponding French application No. 0065337; completed Apr. 10, 2009.
Office Action issued in corresponding Japanese Patent Application No. 2006-176752; issued Apr. 21, 2009.

* cited by examiner

*Primary Examiner*—Ricardo L Osorio
(74) *Attorney, Agent, or Firm*—Brinks Hofer Gilson & Lione

(57) ABSTRACT

A liquid crystal display system reduces a consumed current and reduces generation of heat in a data integrated circuit, the liquid crystal display device includes a liquid crystal cell array, a first charge sharing circuit arranged on one side of the liquid crystal cell array to pre-charge the data lines before the data lines are charged with a data voltage, and a second charge sharing circuit arranged outside the other side of the liquid crystal cell array to pre-charge the data lines before the data lines are charged with a data voltage.

14 Claims, 13 Drawing Sheets

FIG.3
RELATED ART

| | | | | | | | |
|---|---|---|---|---|---|---|---|
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |

(a)

| | | | | | | | |
|---|---|---|---|---|---|---|---|
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |

(b)

FIG. 4
RELATED ART

| | | | | | | | |
|---|---|---|---|---|---|---|---|
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |

(a)

| | | | | | | | |
|---|---|---|---|---|---|---|---|
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |

(b)

FIG. 5
RELATED ART

| | | | | | | | |
|---|---|---|---|---|---|---|---|
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |

(a)

| | | | | | | | |
|---|---|---|---|---|---|---|---|
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |

(b)

FIG. 6
RELATED ART

| | | | | | | | |
|---|---|---|---|---|---|---|---|
| + | − | + | − | + | − | + | − |
| + | − | + | − | + | − | + | − |
| − | + | − | + | − | + | − | + |
| − | + | − | + | − | + | − | + |
| + | − | + | − | + | − | + | − |
| + | − | + | − | + | − | + | − |
| − | + | − | + | − | + | − | + |
| − | + | − | + | − | + | − | + |

(a)

| | | | | | | | |
|---|---|---|---|---|---|---|---|
| − | + | − | + | − | + | − | + |
| − | + | − | + | − | + | − | + |
| + | − | + | − | + | − | + | − |
| + | − | + | − | + | − | + | − |
| − | + | − | + | − | + | − | + |
| − | + | − | + | − | + | − | + |
| + | − | + | − | + | − | + | − |
| + | − | + | − | + | − | + | − |

(b)

RGB
H,V
CLK
201
TIMING
CONTROLLER
RGB
DDC
GDC
202
DATA DRIVING CIRCUIT
SOE
D1
D2
D3
Dm
SW2
Vcom
Clc
Cst
T
G1
Gn
SW1
205
204
206
GATE
DRIVING
CIRCUIT
203

LIQUID CRYSTAL DISPLAY DEVICE AND METHOD OF DRIVING THE SAME

This application claims the benefit of the Korean Patent Application No. 2005-0077302 filed in Korea on Aug. 23, 2005, which is hereby incorporated by reference herein.

BACKGROUND

1. Technical Field

The present invention relates to a liquid crystal display device, and more particularly to a liquid crystal display device and a method of driving the same capable of reducing a consumed current and of reducing the generation of heat in an integrated circuit.

2. Description of the Related Art

Recently, liquid crystal display (LCD) devices are more widely used in a variety of electronic products because of their features such as lightweight, slimness, low power consumption and so on. According to such a trend, the liquid crystal display devices have been used in office automation equipment, audio and video equipment and so on. Such a liquid crystal display device controls a light transmittance in accordance with a signal applied to a plurality of switching devices arranged in a matrix to display desired pictures on a screen. A thin film transistor (TFT) are mainly employed for the switching devices.

FIG. 1 shows a related art liquid crystal display device. As shown in FIG. 1, the related art liquid crystal display device includes a liquid crystal display panel 14 in which data lines D1 to Dm cross gate lines G1 to Gn, respectively, and a TFT is arranged at each crossing part for driving a liquid crystal cell Clc. A data driving circuit 12 supplies a video signal to the data lines D1 to Dm of the liquid crystal display panel 14. A gate driving circuit 13 supplies a scanning pulse to the gate lines G1 to Gn of the liquid crystal display panel 14. A timing controller 11 controls the data driving circuit 12 and the gate driving circuit 13.

The liquid crystal panel 14 has liquid crystals injected between two glass substrates, i.e., upper and lower glass substrates. The data lines D1 to Dm and the gate lines G1 to Gn are formed to cross each other perpendicularly and are formed together on the lower glass substrate. The TFT arranged at each crossing part of the data lines D1 to Dm and the gate lines G1 to Gn may provide video signals on the data lines D1 to Dm to the liquid crystal cell Clc in response to scanning pulses from the gate lines G1 to Gn. A gate electrode of the TFT is connected to the gate lines G1 to Gn, and a source electrode of the TFT is connected to the data lines D1 to Dm. Further a drain electrode of the TFT is connected to a pixel electrode of the liquid crystal cell Clc. A common voltage Vcom is supplied to a common electrode facing the pixel electrode. Further, the liquid crystal cell Clc of the liquid crystal display panel 14 is provided with a storage capacitor Cst for fixedly sustaining a voltage charged in the liquid crystal cell Clc. The storage capacitor Cst may be provided between a liquid crystal cell Clc connected to nth gate line and (n-1)th pre-stage gate line or between a liquid crystal cell Clc connected to nth gate line and a common storage line (not shown).

The data driving circuit 12 includes a plurality of data driving integrated circuits, each of which has a designated number of channels. Herein, the data driving integrated circuit includes a shift register for sampling a clock, a register for temperately storing data, a latch for storing the data by one line in response to a clock signal from the shift register and then simultaneously outputting the stored data corresponding to the one line, a digital to analog converter for selecting positive/negative gamma voltages corresponding to a value of the data from the latch, a multiplexer for selecting one of the data lines D1 to Dm to which an analog data (i.e., a video signal) converted by the positive/negative gamma voltage is applied, and an output buffer connected between the multiplexer and the selected data line. Such a data driving integrated circuit supplies the video signals to the data lines D1 to Dm under a control of the timing controller 11.

The gate driving circuit 13 includes a shift register for sequentially generating the scanning pulse, a level shifter for shifting a voltage of the scanning pulse to a voltage level suitable for driving the liquid crystal cell Clc. Such a gate driving circuit 13, under a control of the timing controller 11, supplies the scanning pulse sequentially synchronized with the video signal to the gate lines G1 to Gn.

The timing controller 11 employs vertical(V)/horizontal (H) signals and the clock(CLK) to generate a gate controlling signal (GDC) for controlling the gate driving circuit 13, and a data control signal (DDC) for controlling the data driving circuit 12. The DDC includes a source start pulse (SSP), a source shift clock (SSC), a source output enable (SOE), and a polarity signal (POL). The signal GDC includes a gate shift clock (GSC), a gate output signal (GOE) and a gate start pulse (GSP).

To drive the liquid crystal cell Clc in the liquid crystal display panel 14, the liquid crystal display device can employ an inversion driving method such as a frame inversion method, a line inversion method, a column inversion method, and/or a dot inversion method.

FIG. 2 represents a frame inversion method, FIG. 3 represents a line inversion method, FIG. 4 represents a column inversion method, FIG. 5 represents a one-dot inversion method, and FIG. 6 represents a two-dot inversion method. In FIGS. 2 to 6, (a) and (b) represents an inversion of a polarity of a video signal supplied every frame to a liquid crystal cells, '+' represents a video signal of a positive polarity supplied to a liquid crystal cell, and '−' represents a video signal of a negative polarity supplied to a liquid crystal cell.

However, such an inversion driving method has problems in that a current consumed by the device is raised due to an inversion of the video signal polarity and also a heat generated by the integrated circuit is raised. Especially, such above problems are deepened in the one-dot and the two-dot inversion driving method in which a polarity of a video signal is inverted every one horizontal interval or two horizontal interval. To solve such problems, a scheme reducing a voltage swing width by pre-charging the data lines D1 to Dm with aid of a charge sharing circuit has been suggested.

The charge sharing is perfectly performed in the data lines adjacent from the charge sharing circuit as shown in FIG. 7A. However the effect of the charge sharing is reduced as it becomes more distant from the charge sharing circuit by RC delay as shown in FIG. 7B. The decrease of the charge sharing effect becomes more apparent in a large-sized panel due to an increase of a load according to the large-sized scale.

SUMMARY

A liquid crystal display device and a method of driving the same is capable of reducing a consumed current and of reducing a generation of heat in a data integrated circuit.

A liquid crystal display device includes a liquid crystal cell array in which gate lines cross data lines and liquid crystal cells are arranged. A first charge sharing circuit is arranged on one side of the liquid crystal cell array for pre-charging the data lines before the data lines are charged with a data voltage.

A second charge sharing circuit is arranged on the other side of the liquid crystal cell array for pre-charging the data lines before the data lines are charged with a data voltage.

BRIEF DESCRIPTION OF THE DRAWINGS

These and other objects of the invention will be apparent from the following detailed description with reference to the accompanying drawings, in which:

FIG. 3 is a view showing a line inversion method.

FIG. 4 is a view showing a column inversion method.

FIG. 5 is a view showing an one-dot inversion method.

FIG. 6 is a view showing a two-dot inversion method.

DETAILED DESCRIPTION OF THE PREFERRED EMBODIMENT

Reference will now be made in detail with reference to the accompanying drawings.

Figure 1:
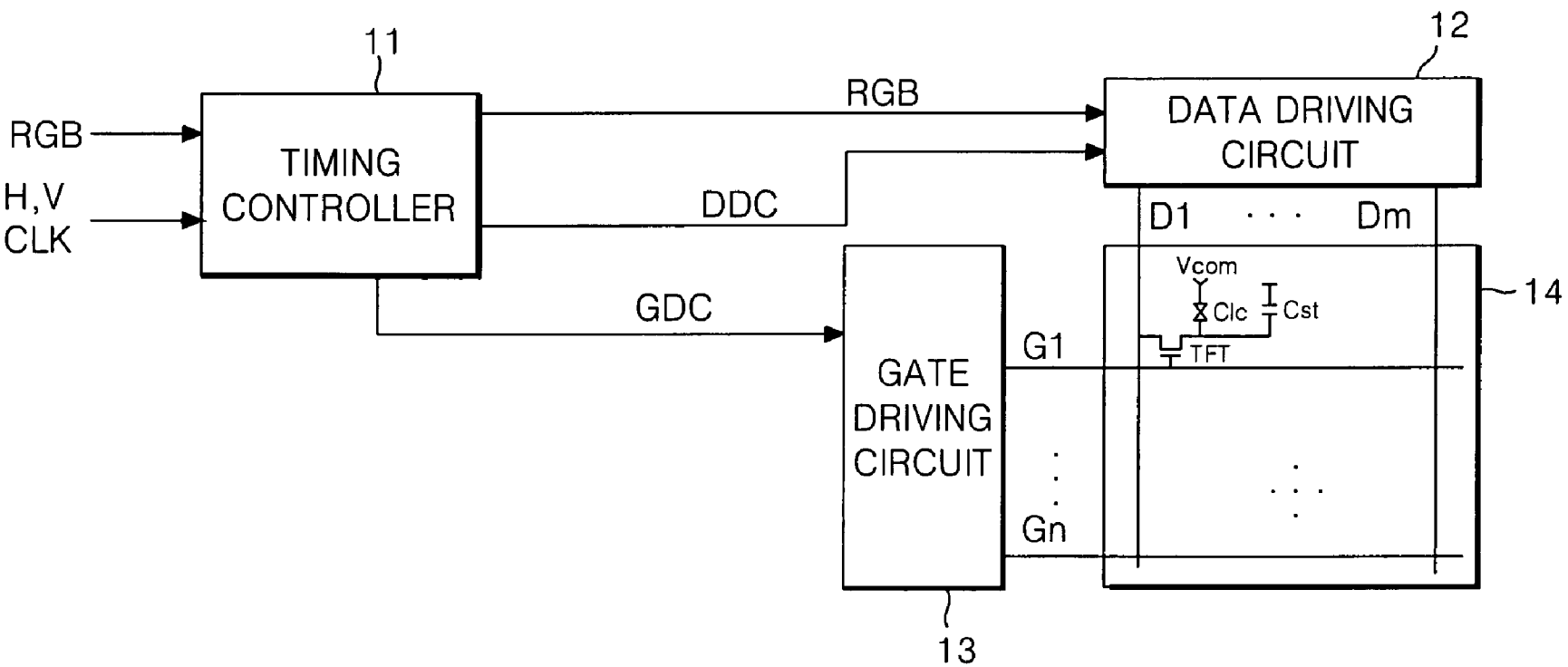
FIG. 1 RELATED ART
FIG. 1 is a diagram showing a related art liquid crystal display device.
Figure 2:
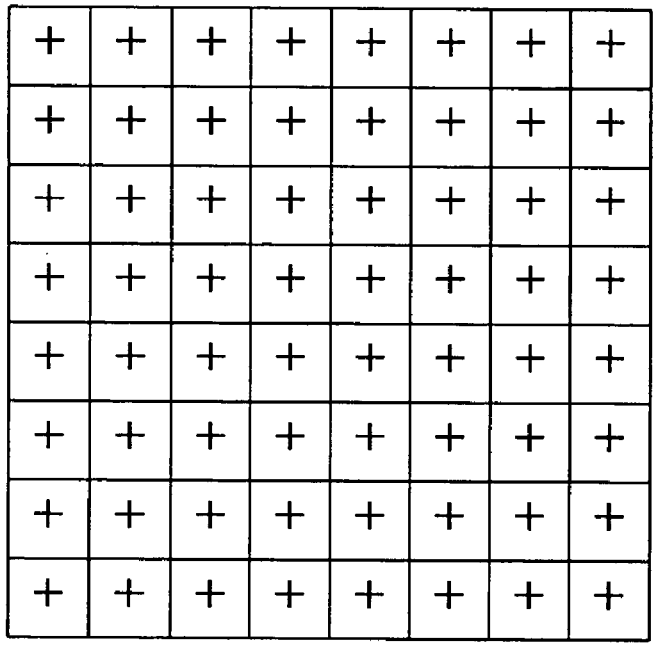
FIG. 2 RELATED ART
FIG. 2 is a view showing a frame inversion method.
Figure 2:
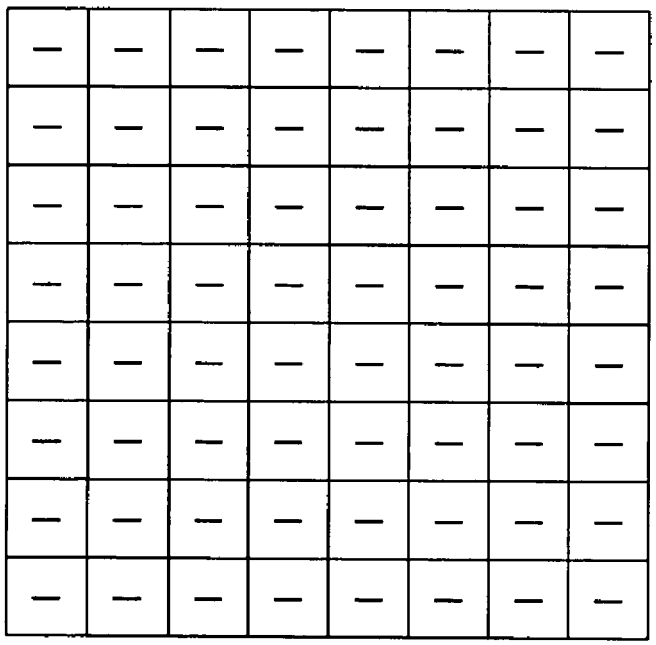
FIG. 2 RELATED ART
Figure 7A:
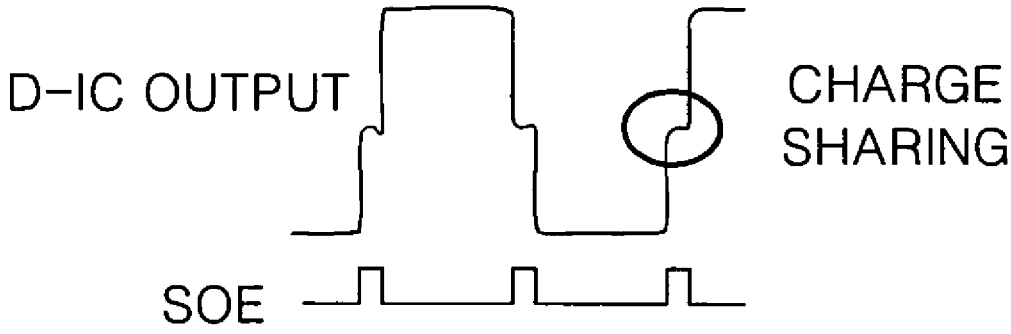
FIG.7A RELATED ART
FIGS. 7A and 7B a reviews showing a data voltage according to a related art charge sharing.
Figure 7B:
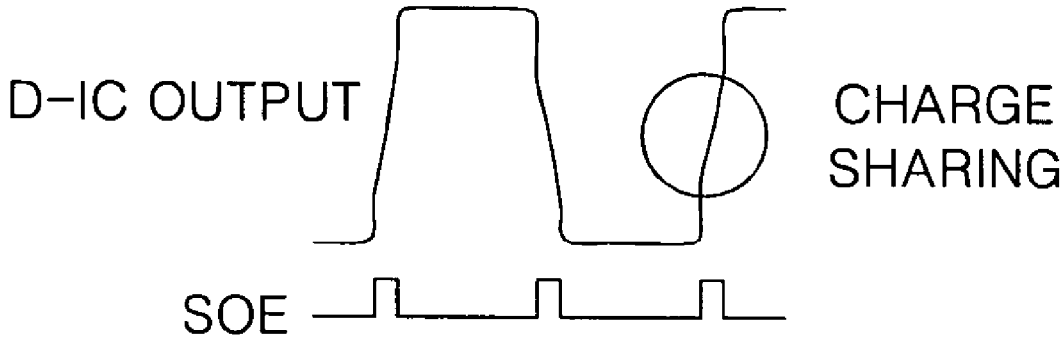
FIG. 7B RELATED ART
Figure 8:
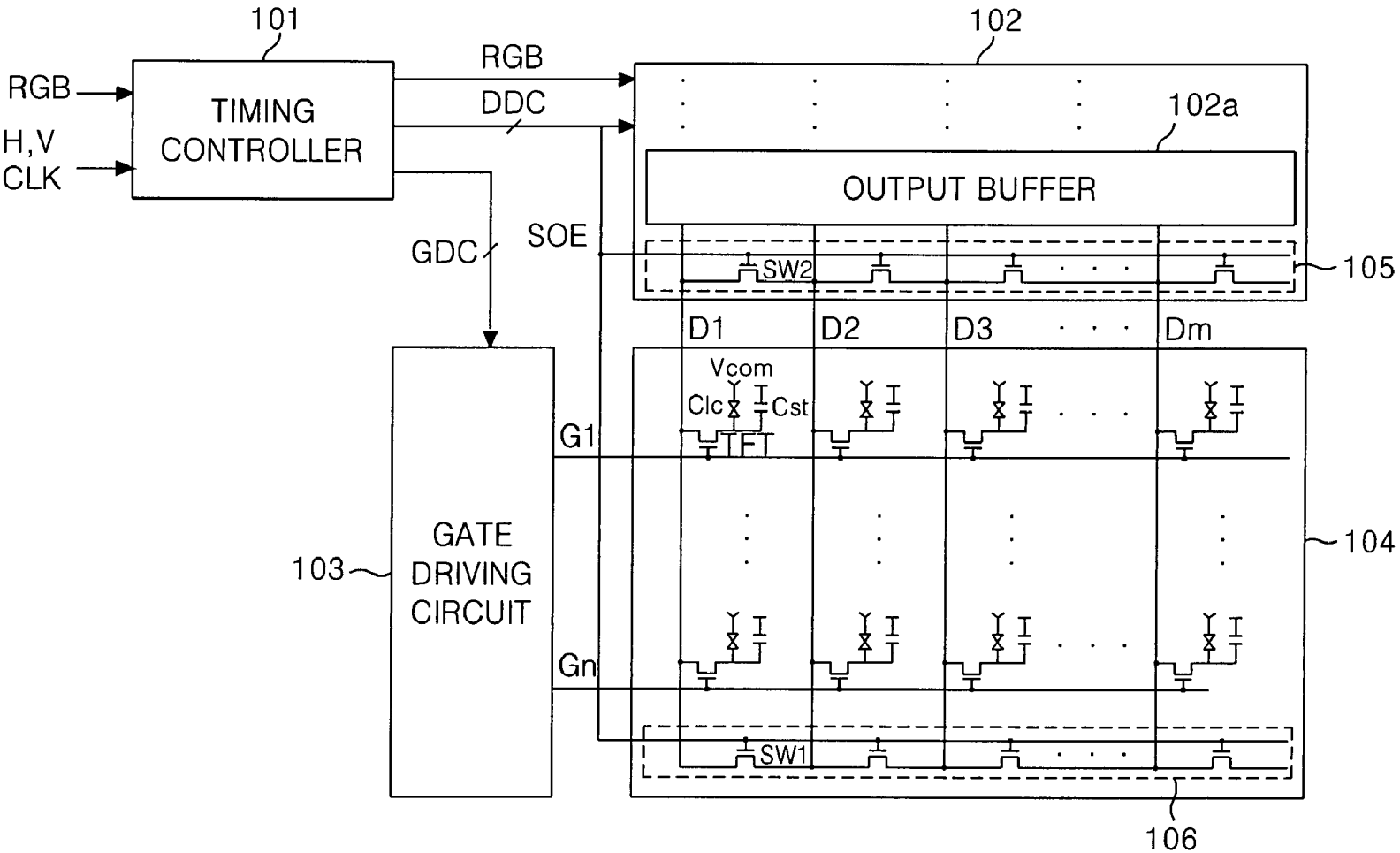
FIG. 8 is a diagram showing a liquid crystal display device.

As shown in FIG. 8, a liquid crystal display device includes a liquid crystal display panel 104 in which gate lines G1 to Gn cross data lines D1 to Dm, respectively, and a liquid crystal array with a plurality of liquid crystal cells arranged in the crossing part. A gate driving circuit 103 is operable to supply a scanning pulse to the gate lines G1 to Gn. A data driving circuit 102 is operable to supply a video signal to the data lines D1 to Dm. First and second charge sharing circuits 105 and 106 pre-charge the data lines D1 to Dm; and a timing controller 101 is operable to control the data driving circuit 102, the gate driving circuit 103 and the first and the second charge sharing circuits 106 and 105.

The liquid crystal panel 104 has liquid crystals injected between two glass substrates, i.e., upper and lower glass substrates. The data lines D1 to Dm and the gate lines G1 to Gn are formed to cross each other perpendicularly and formed together on the lower glass substrate. A TFT(thin film transistor) arranged at each crossing part of the data lines D1 to Dm and the gate lines G1 to Gn serves to provide a data voltage on the data lines D1 to Dm to the liquid crystal cell Clc in response to scanning pulses from the gate lines G1 to Gn. A gate electrode of the TFT is connected to the gate lines G1 to Gn, and a source electrode of the TFT is connected to the data lines D1 to Dm. Further a drain electrode of the TFT is connected to a pixel electrode of the liquid crystal cell Clc. A common voltage Vcom is supplied to a common electrode facing the pixel electrode. Further, the liquid crystal cell Clc of the liquid crystal display panel 104 is provided with a storage capacitor Cst for fixedly sustaining a voltage charged in the liquid crystal cell Clc. A first charge sharing circuit 106 is formed at outer side of the liquid crystal cell array in a lower end part of the liquid crystal display panel 104. The first charge sharing circuit includes a plurality of switch devices SW1. The switch devices SW1 are connected to each of the data lines D1 to Dm to simultaneously shut off the data lines D1 to Dm in response to a source output signal SOE from the timing controller 101.

The data driving circuit 102 includes a plurality data driving integrated circuits, each of which has a designated number of channels. Herein, the data driving integrated circuit includes a shift register for sampling a clock, a register for temperately storing data, a latch for storing the data by one line in response to a clock signal from the shift register and then simultaneously outputting the stored data corresponding to the one line, a digital to analog converter for selecting positive/negative gamma voltages corresponding to a value of the data from the latch, a multiplexer for selecting one of the data lines D1 to Dm to which an analog data (i.e., a video signal) converted by the positive/negative gamma voltage is applied, an output buffer 102*a* connected between the multiplexer and the selected data line, and a second charge sharing circuit 105 formed in an output terminal of the output buffer 102*a* and so on. The second charge sharing circuit 105 includes a plurality of switch devices SW2. The switch device SW2 is connected to each of the data lines D1 to Dm to simultaneously shut off the data lines D1 to Dm in response to a source output signal SOE from the timing controller 101. Such a data integrated circuit supplies a data voltage, i.e. a video signal, to the data lines D1 to Dm under the control of the timing controller 101.

The gate driving circuit 103 includes a shift register for sequentially generating the scanning pulse, a level shifter for shifting a voltage of the scanning pulse to a voltage level for driving the liquid crystal cell Clc. Such a gate driving circuit 103, under a control of the timing controller 101, supplies the scanning pulse sequentially synchronized with the video signal to the gate lines G1 to Gn.

The timing controller 101 employs vertical(V)/horizontal (H) signals and the clock(CLK) to generate a gate controlling signal (GDC) that controls the gate driving circuit 103, and a data control signal (DDC) for controlling the data driving circuit 102. The DDC includes a source start pulse (SSP), a source shift clock (SSC), a source output enable (SOE), and a polarity signal (POL). The signal GDC includes a gate shift clock (GSC), a gate output signal (GOE) and a gate start pulse (GSP).

Figure 9:
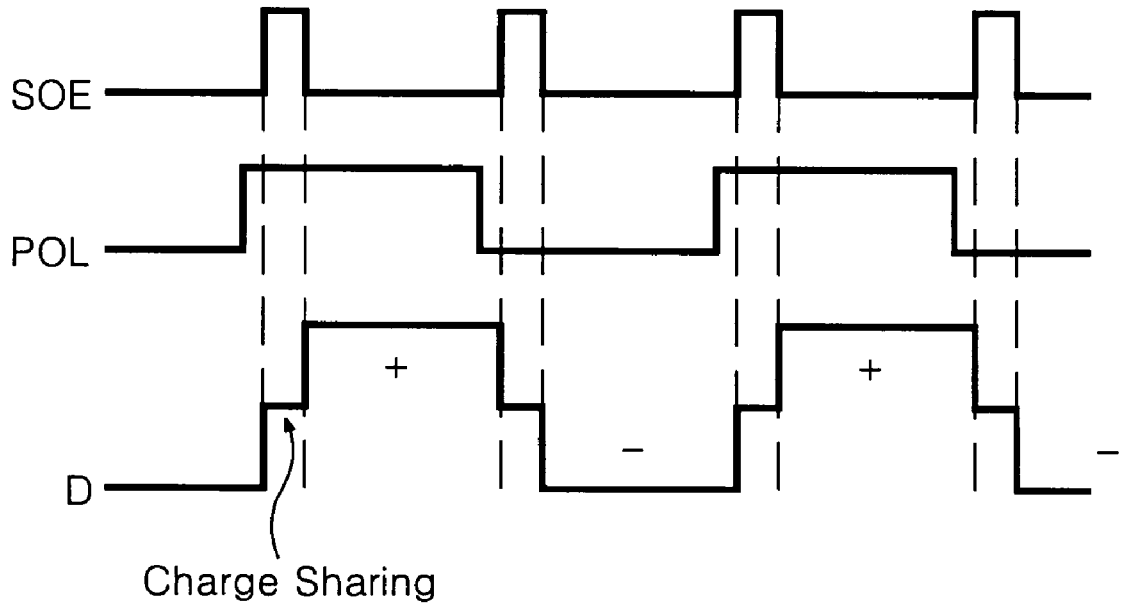
FIG. 9 is a view showing a data voltage according to a charge sharing.

FIG. 9 represents a signal supplied to each liquid crystal cell via the data lines D1 to Dm. Herein, "SOE" represents a source output signal, "POL" represents a polarity signal, and "D" represents a video signal. The video signal D is controlled by the polarity signal POL, and the source output signal SOE is supplied to the data lines D1 to Dm in a low interval of the source output signal SOE.

Hereinafter, a charge sharing process by the first and the second charge sharing circuits 106 and 105 will be described in reference to FIG. 9. A positive video signal or a negative video signal is supplied from an output buffer 102*a* to the data lines D1 to Dm in the low interval of the source output signal SOE to display a predetermined picture corresponding to the video signal on the liquid crystal display panel 104.

First and second switch devices SW1 and SW2 of the first and the second charge sharing circuits 106 and 105 are turned on in a high interval of the source output signal SOE. When the first and the second switch devices SW1 and SW2 are turned on, the entire data lines D1 to Dm is electrically connected. At this time, an average voltage of the video signal charged to each liquid crystal cell by the video signal supplied in the low interval of the previous source output signal SOE is represented on the data lines D1 to Dm.

When the source output signal SOE is inverted to a low, a negative video signal or a positive video signal is supplied to the data lines D1 to Dm to display a predetermined picture on the liquid crystal display panel 104.

Figure 10A:
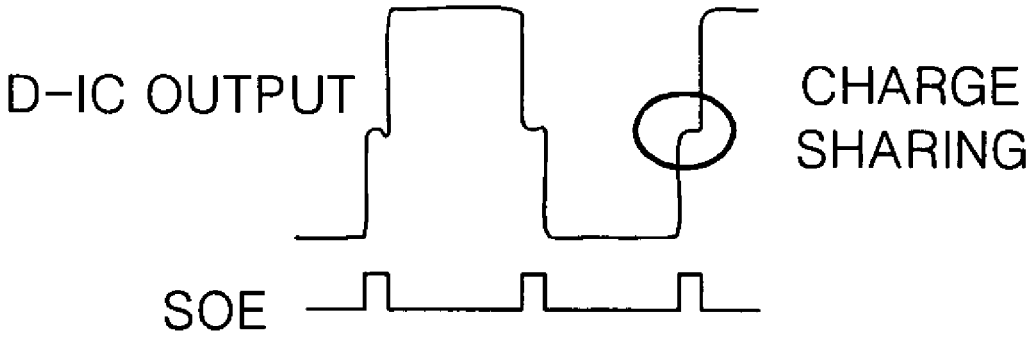
FIGS. 10A and 10B are views showing a data voltage according a charge sharing at the both ends of liquid crystal cell array.
Figure 10B:
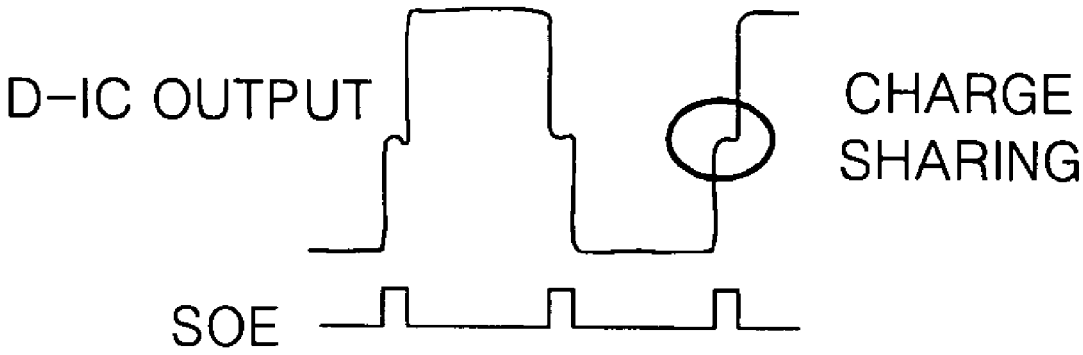

The data lines D1 to Dm are pre-charged to minimize a voltage change level, so that there is an effect that power consumption is reduced and also a generation of heat from a data integrated circuit is reduced. Especially, referring to FIG. 10A and FIG. 10B representing each data voltage waveform by the charge sharing at both ends of the liquid crystal cell array, it is possible to improve the effect of reduced charge sharing by simultaneously performing the charge sharing on one side and on the other side of the liquid crystal cell array by the first and the second charge sharing circuits 106 and 105.

Figure 11:
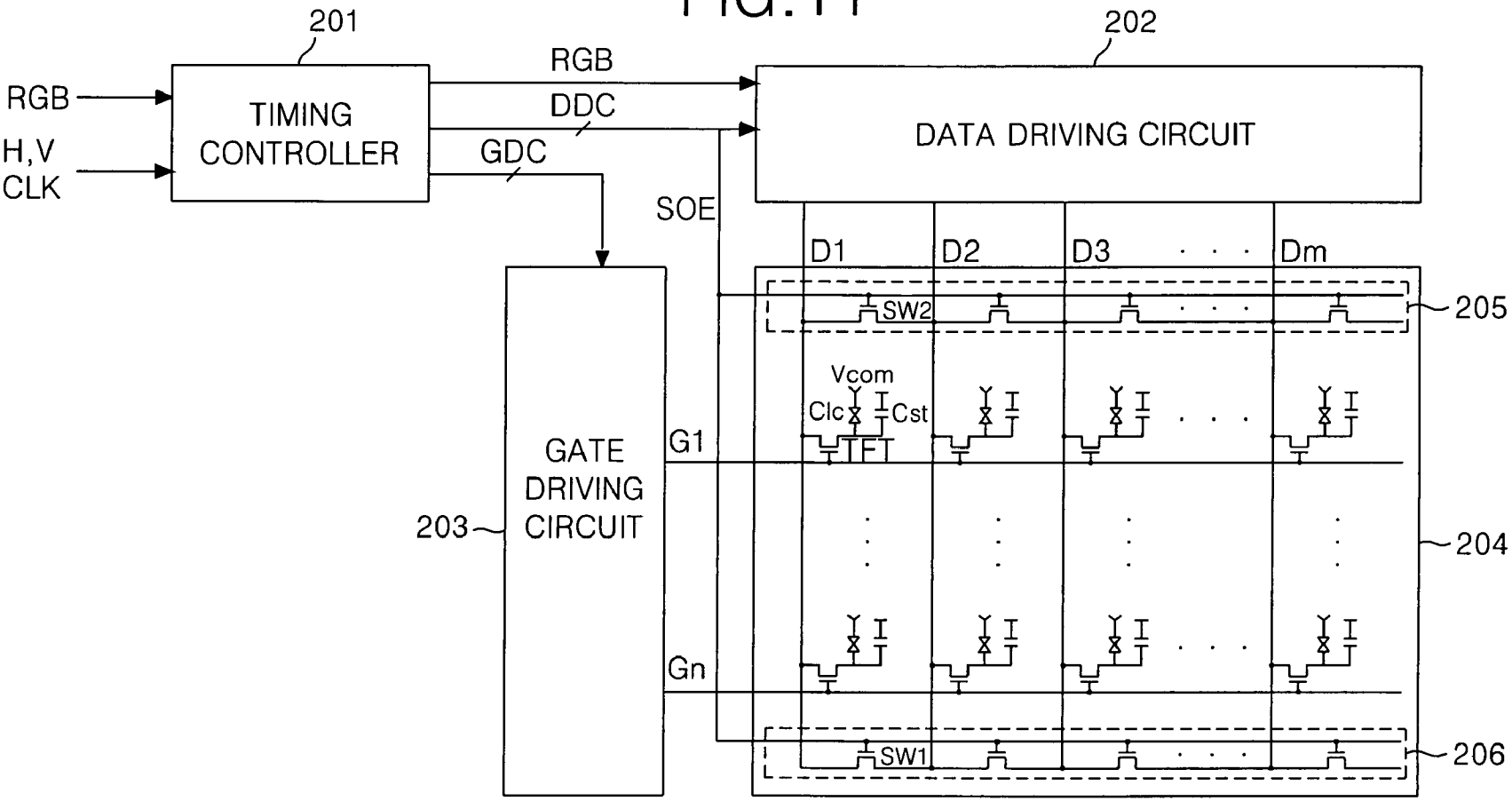
FIG. 11 is a diagram showing a liquid crystal display device.

FIG. 11 represents a liquid crystal display device. As shown in FIG. 11, a liquid crystal display device includes a liquid crystal display panel 204 in which gate lines G1 to Gn cross data lines D1 to Dm, respectively, and a liquid crystal array with a plurality of liquid crystal cells Clc respectively arranged at the crossing part. A gate driving circuit 203 is operable to supply a scanning pulse to the gate lines G1 to Gn. A data driving circuit 202 is operable to supply a data voltage to the data lines D1 to Dm. A first and a second charge sharing circuits 206 and 205 pre-charges the data lines D1 to Dm. A timing controller 201 is operable to control the data driving circuit 202, the gate driving circuit 203 and the first and the second charge sharing circuits 206 and 205.

The liquid crystal panel 204 has liquid crystals injected between two glass substrates, i.e., upper and lower glass substrates. The data lines D1 to Dm and the gate lines G1 to Gn are formed to cross each other perpendicularly and are formed together on the lower glass substrate. The TFT arranged at each crossing part of the data lines D1 to Dm and the gate lines G1 to Gn serves to provide the data voltage on the data lines D1 to Dm to the liquid crystal cell Clc in response to scanning pulses from the gate lines G1 to Gn. A gate electrode of the TFT is connected to the gate lines G1 to Gn, and a source electrode of the TFT is connected to the data lines D1 to Dm. Further a drain electrode of the TFT is connected to a pixel electrode of the liquid crystal cell Clc. A common voltage Vcom is supplied to a common electrode facing the pixel electrode. Further, the liquid crystal cell Clc of the liquid crystal display panel 204 is provided with a storage capacitor Cst for fixedly sustaining a voltage charged in the liquid crystal cell Clc. A first charge sharing circuit 206 and a second charge sharing circuit 205 are formed outside one side and the other outer side of a liquid crystal cell array of the liquid crystal display panel 204. The first and the second charge sharing circuits 206 and 205 include a plurality of switch devices SW1 and switch devices SW2. The switch devices SW1 and SW2 are connected to each of the data lines D1 to Dm to simultaneously shut off the data lines D1 to Dm in response to a source output signal SOE from the timing controller 201.

The data driving circuit 202 includes a plurality of data driving integrated circuits, each of which has a designated number of channels. The data driving integrated circuit includes a shift register for sampling a clock, a register for temporarily storing data, a latch for storing the data by one line in response to a clock signal from the shift register and then simultaneously outputting the stored data corresponding to the one line, a digital to analog converter for selecting positive/negative gamma voltages corresponding to a value of the data from the latch, a multiplexer for selecting one of the data lines D1 to Dm to which an analog data (i.e., a video signal) converted by the positive/negative gamma voltage is applied, and an output buffer connected between the multiplexer and the selected data line. Such a data integrated circuit supplies a data voltage, i.e. a video signal, to the data lines D1 to Dm under the control of the timing controller 201.

The gate driving circuit 203 includes a shift register for sequentially generating the scanning pulse, a level shifter for shifting a voltage of the scanning pulse to a voltage level suitable for driving the liquid crystal cell Clc. Such a gate driving circuit 203, under a control of the timing controller 201, supplies the scanning pulse sequentially synchronized with the video signal to the gate lines G1 to Gn.

The timing controller 201 employs vertical(V)/horizontal (H) signals and the clock(CLK) to generate a gate controlling signal (GDC) for controlling the gate driving circuit 203, and a data control signal (DDC) for controlling the data driving circuit 202. The DDC includes a source start pulse (SSP), a source shift clock (SSC), a source output enable (SOE), and a polarity signal (POL). The signal GDC includes a gate shift clock (GSC), a gate output signal (GOE) and a gate start pulse (GSP).

As described above, the liquid crystal display includes the charge sharing circuits coupled to one side and the other side of the liquid crystal cell array to maximize an effect of the charge sharing of the data line, so that a consumed current and a generation of heat of the data integrated circuit are reduced.

Although the disclosure has been explained by the embodiments shown in the drawings described above, it should be understood to the ordinary skilled person in the art that the disclosure is not limited to the embodiments, but rather that various changes or modifications thereof are possible without departing from the spirit of the disclosure. Accordingly, the scope of the disclosure should be determined only by the appended claims and their equivalents.

What is claimed is:

1. A liquid crystal display device, comprising:

a liquid crystal cell array;

a first charge sharing circuit coupled with a first side of the liquid crystal cell array, where the first charge sharing circuit is operable to pre-charge a plurality of data lines before the data lines are charged with a data voltage;

a second charge sharing circuit coupled with a second side of the liquid crystal cell array, wherein the second charge sharing circuit is operable to pre-charge a plurality of data lines before the data lines are charged with a data voltage; and a data driving circuit for supplying a data voltage to the data lines in response to a low interval of a previous source output signal, wherein the first charge circuit and the second charge circuit are operable to pre-charge of the data lines in response to a high interval of a present source output signal.

2. The liquid crystal display device according to claim 1, further comprising:

a liquid crystal display panel in which the liquid crystal cell array is formed;

a gate driving circuit operable to supply a scanning pulse to the gate lines; and a timing controller operable to control the data driving circuit, the gate driving circuit and the charge sharing circuits.

3. The liquid crystal display device according to claim 2, wherein the first charge sharing circuit and the second charge sharing circuit are formed in the liquid crystal display panel.

4. The liquid crystal display device according to claim 2, wherein the first charge sharing circuit is formed in the liquid crystal display panel and the second charge sharing circuit is formed within the data driving circuit.

5. The liquid crystal display device according to claim 4, wherein the first charge sharing circuit is positionable in an output terminal of an output buffer of the data driving circuit.

6. A charge sharing device comprising:

a first sharing circuit coupled with a first side of the liquid crystal cell array in which a plurality of liquid crystal cells are arranged and connected to the liquid crystal cells to pre-charge the data lines before the data lines are charged with a data voltage for supplying a video signal; and a second charge sharing circuit coupled with a second side of the liquid crystal cell array to pre-charge the data lines before the data lines are charged with a data voltage, a data driving circuit for supplying a data voltage to the data lines in response to a low interval of a previous source output signal, wherein the first charge circuit and the second charge circuit are operable to pre-charge of the data lines in response to a high interval of a present source output signal.

7. The charge sharing device according to claim 6, wherein the first charge sharing circuit and the second charge sharing circuit comprise switch devices connected to the data lines, and the switch devices are simultaneously operable in response to a source output signal.

8. A data driving device for a liquid crystal display comprising:

a first charge sharing circuit, wherein the first charge sharing circuit is operable to pre-charge a plurality of data lines before the data lines are charged with a data voltage; and a second charge sharing circuit, where the second charge sharing circuit is operable to pre-charge a plurality of data lines before the data lines are charged with a data voltage, a data driving circuit for supplying a data voltage to the data lines in response to a low interval of a previous source output signal, wherein the first charge circuit and the second charge circuit are operable to pre-charge of the data lines in response to a high interval of a present source output signal.

9. The liquid crystal display device according to claim 8, further comprising:

a data driving circuit operable to supply the data voltage to the data lines;

a gate driving circuit operable to supply a scanning pulse to gate lines; and a timing controller operable to control the data driving circuit, the gate driving circuit and the charge sharing circuits.

10. The driving device according to claim 9, wherein the first charge sharing circuit and the second charge sharing circuit are formed in the liquid crystal display panel.

11. The driving device according to claim 9, wherein the first charge sharing circuit is formed in a liquid crystal display panel and the second charge sharing circuit is formed within the data driving circuit.

12. The driving device according to claim 11, wherein the first charge sharing circuit is positionable in an output terminal of an output buffer of the data driving circuit.

13. A liquid crystal driving apparatus comprising:

a liquid crystal cell array;

a first means for pre-charging a plurality of data lines before the data lines are charged with a data voltage; and a second means for pre-charging a plurality of data lines before the data lines are charged with a data voltage, means for supplying a data voltage to the data lines in response to a low interval of a previous source output signal, wherein the first and second means are operable to pre-charge of the data lines in response to a high interval of a present source output signal.

14. The liquid crystal driving apparatus according to claim 13, further comprising:

means for supplying a scanning pulse to the gate lines; and means for controlling the data driving circuit, the gate driving circuit and the charge sharing circuits.

* * * * *